US006976546B2

(12) United States Patent
Herst

(10) Patent No.: US 6,976,546 B2
(45) Date of Patent: Dec. 20, 2005

(54) DRILLING MUD FILTRATION DEVICE

(75) Inventor: Neil Herst, Houston, TX (US)

(73) Assignee: Varco I/P, Inc., Houston, TX (US)

( * ) Notice: Subject to any disclaimer, the term of this patent is extended or adjusted under 35 U.S.C. 154(b) by 0 days.

(21) Appl. No.: 10/453,370

(22) Filed: Jun. 3, 2003

(65) Prior Publication Data

US 2004/0079551 A1 Apr. 29, 2004

Related U.S. Application Data

(60) Provisional application No. 60/422,150, filed on Oct. 29, 2002.

(51) Int. Cl.[7] ..... E21B 21/01; E21B 21/06; B01D 27/00; B01D 35/02

(52) U.S. Cl. ..... 175/57; 175/206; 175/207; 210/435; 210/448; 210/452

(58) Field of Search ..... 175/66, 206, 207, 175/209, 216, 211, 57; 210/167, 435, 448, 210/452, 500.1, 500.25, 510.1

(56) References Cited

U.S. PATENT DOCUMENTS 3,458,050 A * 7/1969 Cooper ..... 210/448
3,749,250 A * 7/1973 Oldford ..... 210/448
3,752,507 A * 8/1973 Maurer et al. ..... 285/12
4,090,573 A * 5/1978 Rankin ..... 175/45
4,336,850 A * 6/1982 Fielder ..... 175/393
4,410,425 A * 10/1983 Gardes ..... 210/167
4,456,531 A * 6/1984 Kubota et al. ..... 210/409
4,495,073 A * 1/1985 Beimgraben ..... 210/448
4,674,579 A * 6/1987 Geller et al. ..... 175/45
5,107,940 A * 4/1992 Berry ..... 175/85
5,148,880 A * 9/1992 Lee et al. ..... 175/393
D345,412 S * 3/1994 Myrvik et al. ..... D23/209
6,598,685 B1 * 7/2003 Mashburn ..... 175/57

OTHER PUBLICATIONS

International Search Report for International Application No. PCT/US03/17458; 3pp.
International Search Report mailed Apr. 27, 2005, for International Application PCT/US2003/017458 filed Jun. 3, 2003 (11 pgs.).

* cited by examiner

*Primary Examiner*—Frank S. Tsay
*Assistant Examiner*—Shane Bomar
(74) *Attorney, Agent, or Firm*—Christie, Parker & Hale, LLP

(57) ABSTRACT

A filter system for filtering drill bit cuttings, shavings, and other abrasive articles from a drilling mud that is passed through an oil or gas well drilling system is provided that includes an overhead drilling system, a drill string connected to the overhead drilling system, and a mud filter for filtering the drilling mud, wherein the mud filter is disposed within a drilling mud fluid passageway that extends from the entry point of the drilling mud into the overhead drilling system and the entry point of the drilling mud into the drill string.

32 Claims, 5 Drawing Sheets

DRILLING MUD FILTRATION DEVICE

CROSS-REFERENCE TO RELATED APPLICATION

This application claims priority under 35 U.S.C. §119(e) to U.S. Provisional Application Ser. No. 60/422,150, filed on Oct. 29, 2002, the disclosure of which is incorporated by reference.

FIELD OF THE INVENTION

This invention relates to an improved apparatus and method for filtering drill bit cuttings, shavings and other abrasive articles from a drilling mud fluid passageway as defined herein in an oil or gas well drilling system, and more particularly, to a mud filter attached to or received within the drilling fluid passageway as defined herein of an overhead drilling system, a top drive drilling system or a power swivel.

BACKGROUND

A drill string consists of a plurality of threadably connected joints of drill pipe, wherein each drill pipe has a length of approximately thirty feet long. One end of each drill pipe has internal threads (the "box" end of the pipe), and an opposite end of each drill pipe has external threads (the "pin" end of the pipe). A series of three threadingly connected drill pipes is commonly referred to as a "stand" of drill pipe. Each stand has a length of approximately 90 feet. Multiple stands of ready to use drill pipe are typically stored vertically supported by the drill floor and restrained in an assembly commonly referred to as a fingerboard.

A top drive well drilling apparatus typically includes a top drive system (TDS). The TDS includes a tubular main shaft, a lower end of which is threadingly connectable to an upper end of a drill string. The TDS drives the drill string rotatively and moves upwardly and downwardly with the drill string during a drilling operation. The TDS includes a motor to drive the main shaft, and therefore the drill string, during a drilling operation. The TDS includes an assembly for receiving drilling fluid. During the drilling operation, the drilling fluid (commonly referred to as "drilling mud", or simply "mud") is pumped through the TDS to the drill string and down to the drill bit to provide lubricity to the drill bit, thereby facilitating the drilling operation. However, during drilling drill bit cuttings, shavings and other abrasive articles (hereinafter referred to as waste products) accumulate in the drilling mud. The waste products can cause extensive wear to the interior surfaces of the drill string and the drill bit and to drilling parameter measuring devices. Consequently it is desirable to filter the drilling mud to remove the accumulated waste products.

In conventional filtration systems a mud filter or screen is inserted into the box end of a stand of drill pipe that is to be attached to the drill string. However, in order to insert the filter an oil well operator (commonly referred to as a "roughneck") must be lifted the approximately 90 feet to the top of the stand of drill pipe. This is typically accomplished by placing the roughneck in an apparatus called a riding belt. This procedure is very dangerous, and produces an undesirably high risk of serious injury or death to the roughneck.

Accordingly, there is a need for an improved method and device for filtering drilling mud in an oil or gas well drilling system that does not create a risk of injury to the roughneck.

SUMMARY OF THE INVENTION

The present invention is directed to a filter system for filtering drill bit cuttings, shavings, and other abrasive articles from a drilling mud that is passed through an oil or gas well drilling system.

In one embodiment, the system includes an overhead drilling system, a drill string connected to the overhead drilling system, and a mud filter for filtering the drilling mud. In such an embodiment the mud filter is preferably disposed within a drilling mud fluid passageway that extends from the entry point of the drilling mud into the overhead drilling system to the entry point of the drilling mud into the drill string.

In another embodiment, the system further includes a saver sub having an upper end that connects to the overhead drilling system and a lower end that connects to a drill string. In this embodiment, the mud filter is received within the saver sub.

Another embodiment of the invention is directed to a method for filtering drill bit cuttings, shavings, and other abrasive articles from a drilling mud that is passed through an oil or gas well drilling system.

In one embodiment, the method includes providing a drill string, providing an overhead drilling system that rotatably drives the drill string, providing a mud filter for filtering the drilling mud, and positioning the mud filter within a drilling mud fluid passageway that extends from the entry point of the drilling mud into the overhead drilling system and the entry point of the drilling mud into the drill string.

In another embodiment, the method further includes providing a saver sub having an inner fluid passageway that forms a portion of the drilling mud fluid passageway, attaching an upper end of the saver sub to the overhead drilling system, attaching a lower end of the saver sub to the drill string, and positioning at least a portion of the mud filter within the inner fluid passageway of the saver sub.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

This invention relates to an improved apparatus and method for filtering drill bit cuttings, shavings, and other abrasive articles (herein after referred to as waste products) from a drilling mud fluid passageway, as defined below, in an oil or gas well drilling system, and more particularly, to a mud filter attached to or received within the drilling fluid passageway, as defined below, of an overhead drilling system, a top drive drilling system or a power swivel.

Figure 1:
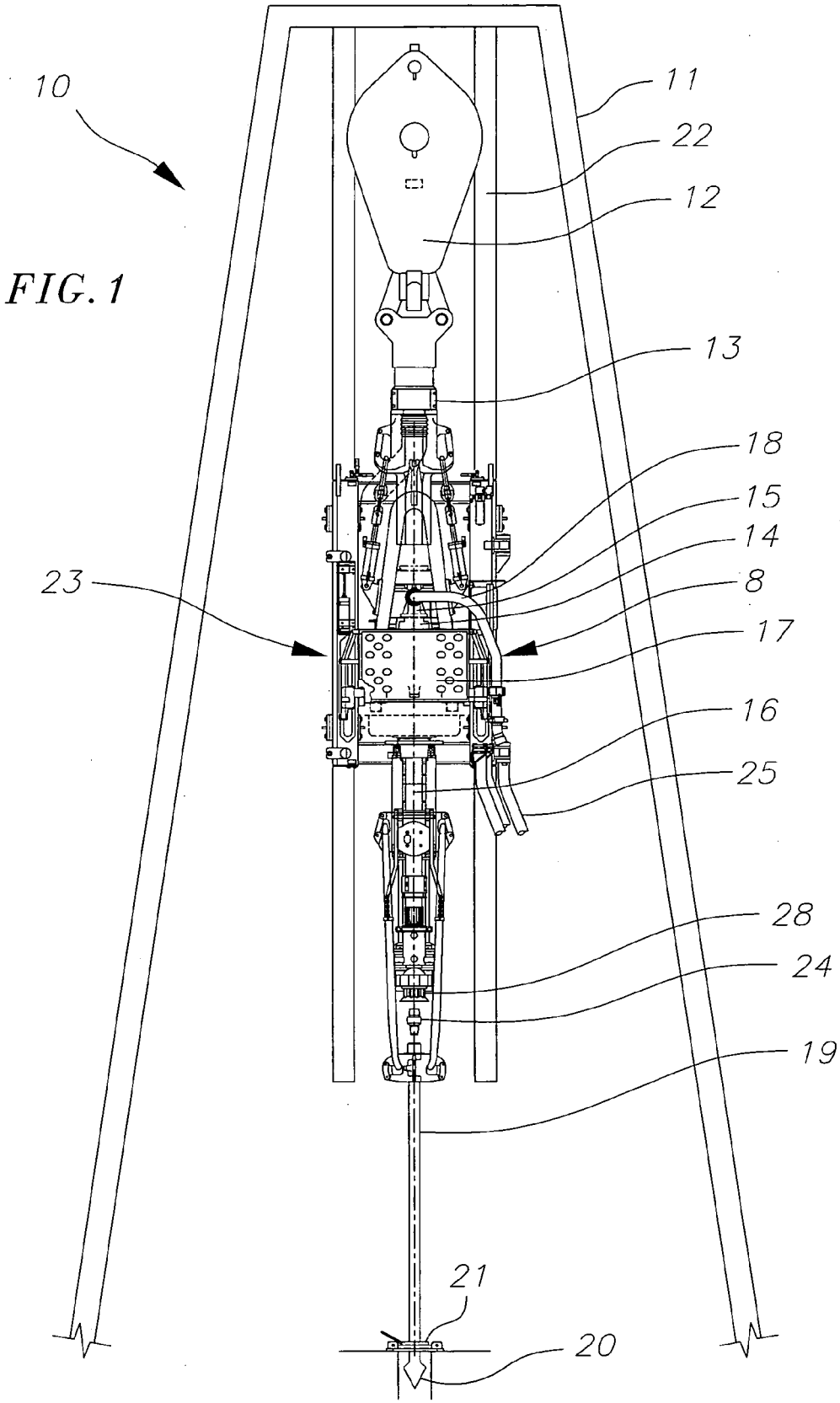
FIG. 1 is a schematic of a top drive drilling apparatus, having a top drive system, a saver sub, and a drill string.

FIG. 1 illustrates a top drive well drilling apparatus 10 used in a drilling operation of an oil or gas well. The drilling apparatus 10 is structurally supported by a derrick 11. The drilling apparatus 10 comprises a plurality of mechanical components including: a hook 13, a top drive system (TDS) or overhead drilling system 23 attached to the hook 13, a saver sub 24 attached to the TDS 23, a drill string 19 attached to the saver sub 24 and a drill bit 20 attached to the drill string 19. In one embodiment, as shown in FIG. 1, the TDS 23 comprises a washpipe bonnet 14, a gooseneck 15 that extends from the washpipe bonnet 14, an S-pipe 18 that connects to the gooseneck 15, a main shaft 16, and a motor housing 17.

In the embodiment depicted in FIG. 1, the mechanical components are collectively suspended from a traveling block 12 that allows the mechanical components to move upwardly and downwardly on rails 22 connected to the derrick 11 for guiding the vertical motion of the mechanical components. The main shaft 16 extends through the motor housing 17 and connects to the drill string 19.

During operation, a TDS motor encased within the motor housing 17 rotates the main shaft 16 which, in turn, rotates the drill string 19 and the drill bit 20. Rotation of the drill bit 20 produces a well bore 21. Drilling fluid (also referred to as drilling mud or mud), pumped from a rotary hose 25 (see FIG. 8) that is connected to the S-pipe 18, travels to the drill bit 20 to lubricate the drill bit 20 to facilitate the drilling operation. The mud filter 26 according to the present invention is placed in a drilling mud fluid passageway 8 to collect waste products that accumulate in the drilling mud fluid passageway during the drilling operation.

As used herein, the phrase "drilling mud fluid passageway" refers to a passageway through which drilling mud passes during a drilling operation that extends from the entry of the drilling mud into the TDS 23 and ends at the entry of the drilling mud into the box end of the drill string 19 that is attached to the TDS 23. For example, in one embodiment, the drilling mud fluid passageway 8 extends from the connection of the rotary hose 25 and the S-pipe 18, continues through the S-pipe 18, the gooseneck 15, the washpipe 14, the TDS 23, the main shaft 16, and the saver sub 24, and ends at the connection of the saver sub 24 to the drill string 19. However in alternative embodiments of the invention, one or more of the components listed in the above example may be omitted. For example, in one embodiment, the TDS 23 may be connected directly to the drill string 19 without the use of the saver sub 24.

Figure 2:
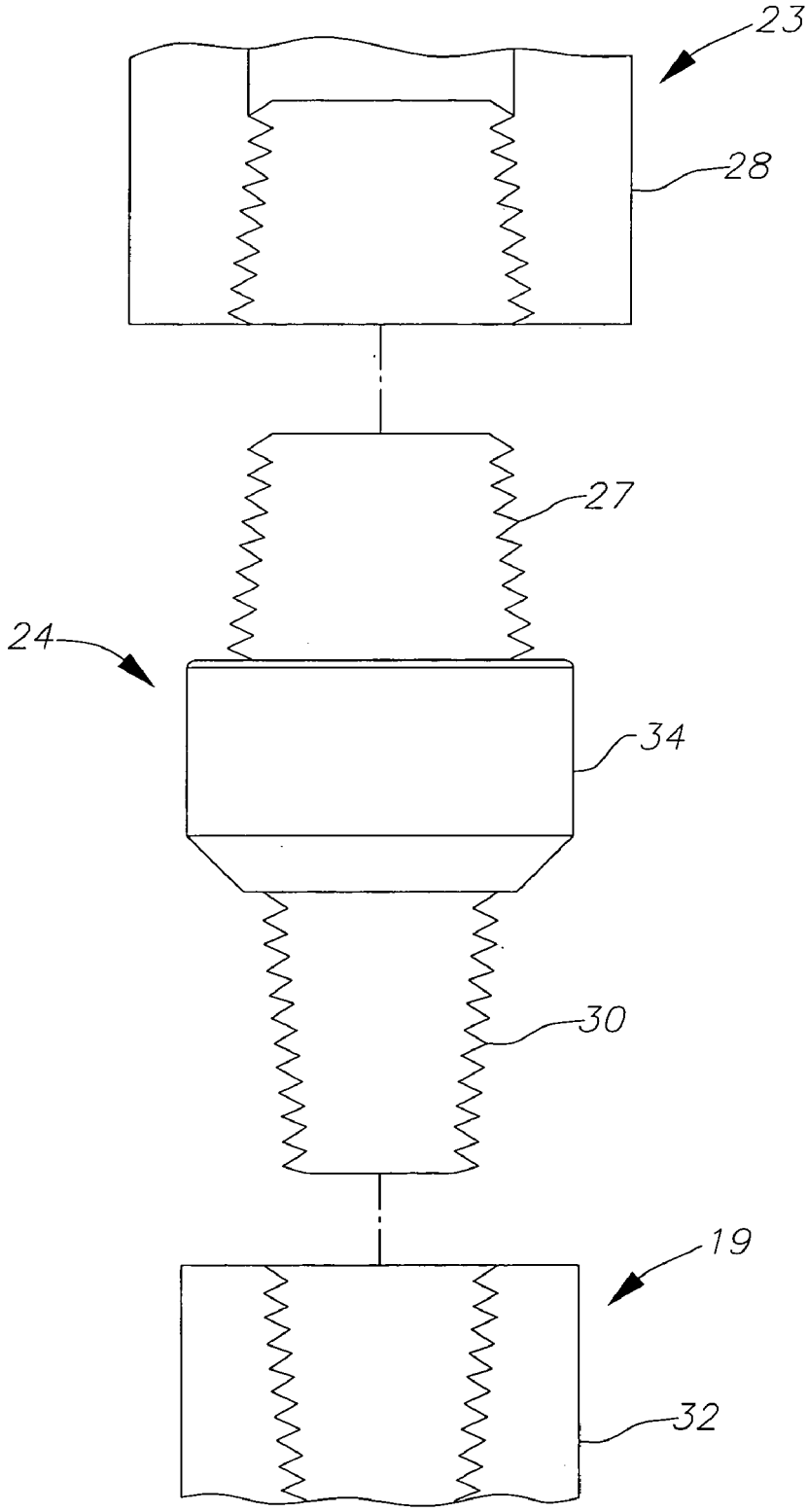
FIG. 2 is a schematic of a portion of FIG. 1, showing a lower end of the top drive system, the saver sub and an upper end of the drill string.

In an embodiment of the current invention in which a saver sub is present on the drilling system, as shown in FIG. 2, the TDS 23 is threadably connected to the saver sub 24, which in turn, is threadably connected to the drill string 19. Although the TDS 23 may be connected directly to the drill string 19, in most operations the saver sub 24 is connected between the TDS 23 and the drill string 19 to "save" the threads of the TDS 23.

For example, if the TDS 23 were connected directly to the drill string 19, and the threads of the TDS 23 were to be damaged, worn out or otherwise failed, the main shaft 16 of the TDS 23 would have to be replaced. By contrast, the saver sub 24 is a sacrificial part that can easily be replaced if its threads wear out, are damaged, or otherwise fail. As a result, the saver sub 24 is connected between the TDS 23 and the drill string 19 to protect the threads in the TDS 23 and increase the useful life of the TDS 23. In one embodiment, the saver sub 24 is constructed from a very hard material, such as a high alloy steel, for example AISI 4340.

Figure 3:
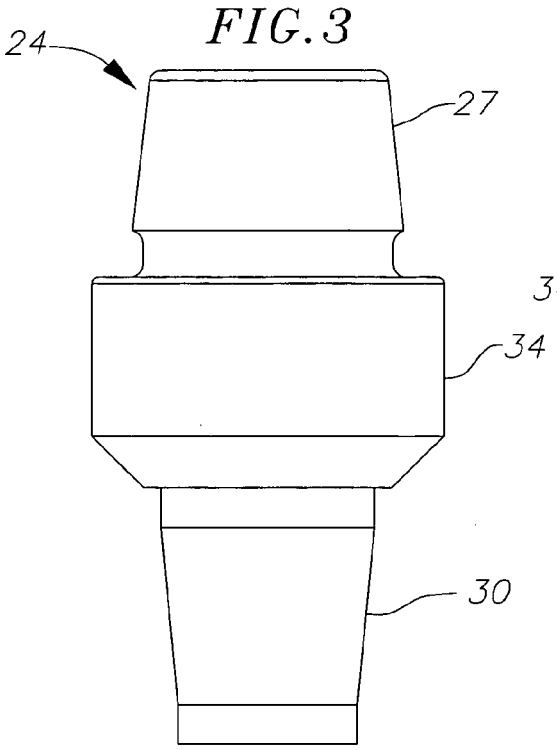
FIG. 3 is a front view of the saver sub of FIG. 1.
Figure 5:
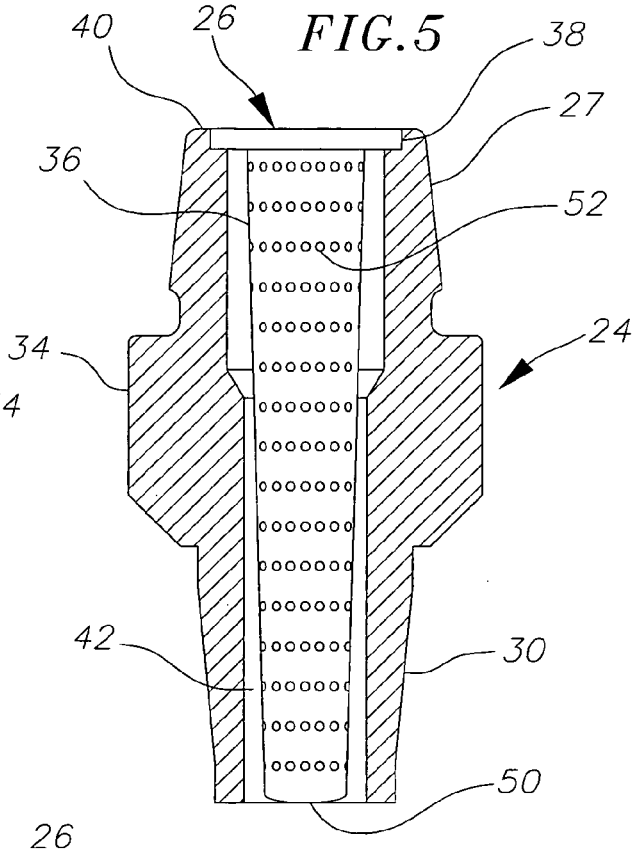
FIG. 5 is a longitudinal cross-section of the mud filter of FIG. 4 disposed within the saver sub of FIG. 3.

As shown in FIGS. 2, 3, and 5, the saver sub 24 is a generally cylindrical hollow tube, having a generally cylindrical hollow interior 42, defining an inner fluid passageway that forms a portion of the drilling mud fluid passageway 8. The saver sub 24 may vary in size, but generally has a length in a range of approximately 14 inches to approximately 17 inches. In the embodiment depicted in FIG. 2, the saver sub 24 includes an upper end 27 having external threads that mate with an internally threaded lower end 28 of the TDS 23, and a lower end 30 having external threads that mate an internally threaded upper end 32 (box end) of the drill string 19. As shown, a body section 34 may be disposed between the threaded sections 27 and 30 of the saver sub 24 to add structural strength to the saver sub 24.

Figure 4A:
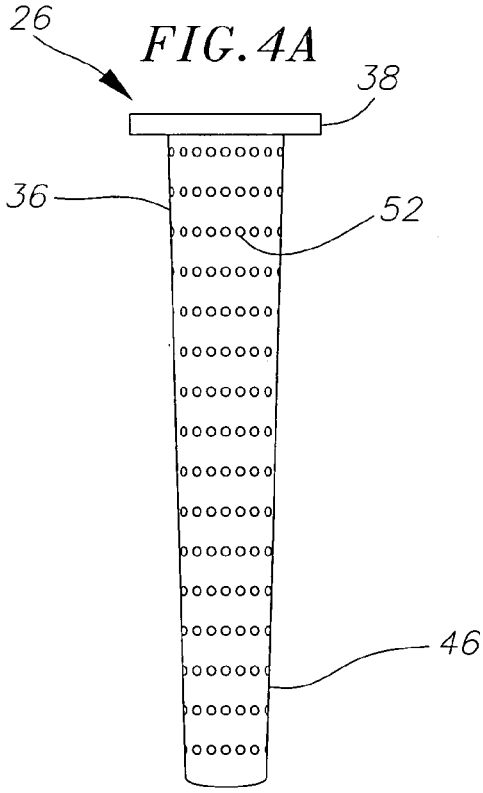
FIG. 4A is a front view of a mud filter according to the present invention.
Figure 4B:
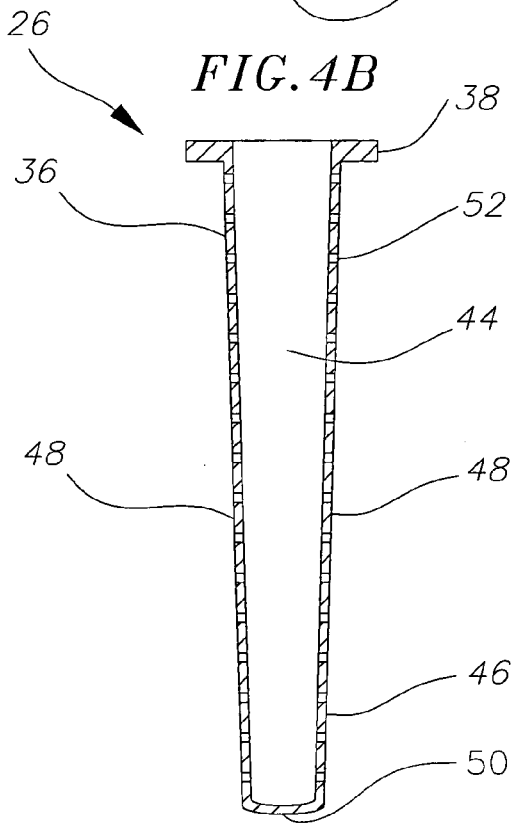
FIG. 4B is a longitudinal cross-section of the mud filter of FIG. 4A.

As shown in FIGS. 4A–4B, in one embodiment the mud filter 26 is generally cylindrical and has a longitudinal cavity 44 that extends from an upper end 36 of the mud filter 26 to a lower end 46 of the mud filter 26. The longitudinal cavity 44 is defined by a spacing between mud filter sidewalls 48. The mud filter sidewalls 48 extend from the upper end of the 36 of the mud filter 26 to the lower end 46 of the mud filter 26, terminating at a mud filter bottom wall 50.

The mud filter 26 is at least partially porous, to allow the drilling mud to pass therethrough, but preventing the waste products from passing therethrough. For example, exemplary porous structures for the mud filter 26 include a metal mesh material, a plurality of welded metal bars, or a generally solid material having a plurality of openings pierced therethrough, among other suitable porous structures.

In the embodiment depicted in FIGS. 4A and 4B, the mud filter 26 includes a solid steel material, such as stainless steel, having a plurality of openings 52 pierced therethrough. In this embodiment, the mud filter 26 is also downwardly tapered to allow for an increasing annular space towards the upper end 36 of the mud filter 26, thus allowing for improved flow of the drilling mud through the mud filter 26. In one embodiment, the openings are generally circular, having a diameter in a range of approximately 2 inches to approximately 4 inches. As with the saver sub 24, the mud filter may vary in size, but generally has a length in a range of approximately 12 inches to approximately 18 inches.

The mud filter 26 according to the present invention may be placed anywhere within the drilling mud fluid passageway 8. For example, in one embodiment, as shown in FIG. 5 the mud filter 26 is received within the saver sub 24. In this embodiment, the upper end 36 of the mud filter 26 contains an annular ring 38 that mates with an annular recess 40 in the upper end 27 of the saver sub 24. In one embodiment, the annular ring 38 of the mud filter 26 may comprise a sealing element such as an o-ring seal (not shown) that is compressed against the annular recess 40 of the saver sub 24 to create a fluid tight seal.

In another embodiment, the annular ring 38 of the mud filter 26 and the annular recess 40 of the saver sub 24 are sufficiently closely toleranced to prevent the waste products from flowing between the annular ring 38 and the annular recess 40 past the mud filter 26. For example, the annular ring 38 and the annular recess 40 may be toleranced to a range of approximately plus or minus 0.002 inches to approximately plus or minus 0.005 inches to ensure no leakage of the waste products.

Although the mud filter 26 may be received within the saver sub 24 such that the mud filter bottom wall 50 protrudes from the lower end 30 of the saver sub 24, in embodiments where the mud filter bottom wall 50 does not protrude from the lower end 30 of the saver sub 24, the mud filter bottom wall 50 is less likely to be damaged when the saver sub 24 is attached to, detached from, or otherwise transported around the top drive well drilling apparatus 10.

Figure 6:
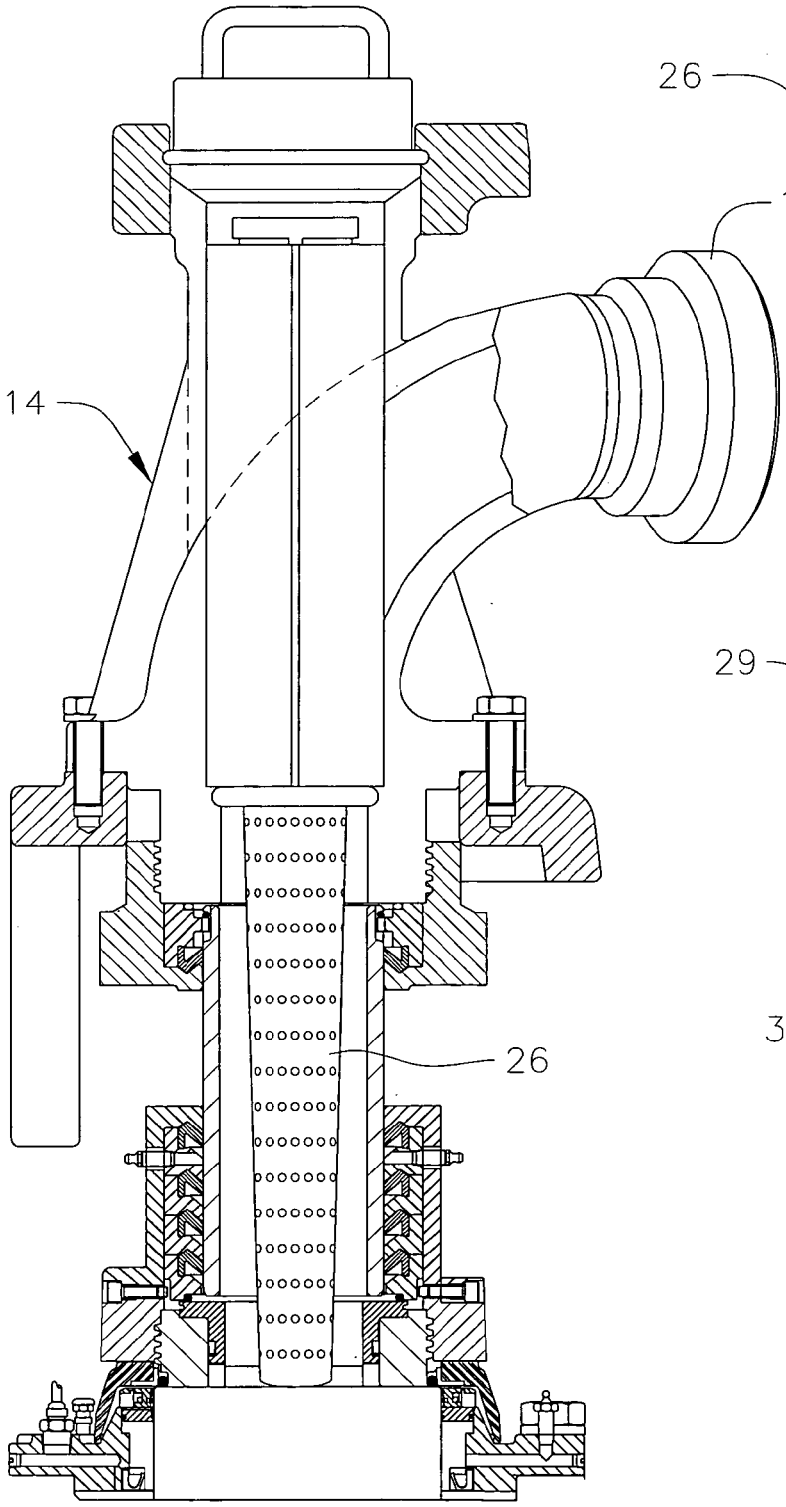
FIG. 6 is a partial cross section of a portion of a washpipe having a mud filter disposed therein.

In another embodiment of the invention, the mud filter 26 is received within the washpipe 14, as show for example in FIG. 6. The mud filter 26 may be received within the washpipe 14 as is described above with respect to the positioning of the mud filter 26 within the saver sub 24. Placement of the mud filter 26 in the washpipe 14 offers the advantage that the length of the mud filter 26 can be made longer than that which is described above. For example, in embodiments where the mud filter 26 is placed in the washpipe 14, the mud filter 26 may have a length in a range of approximately 12 inches to approximately 36 inches.

Figure 7:
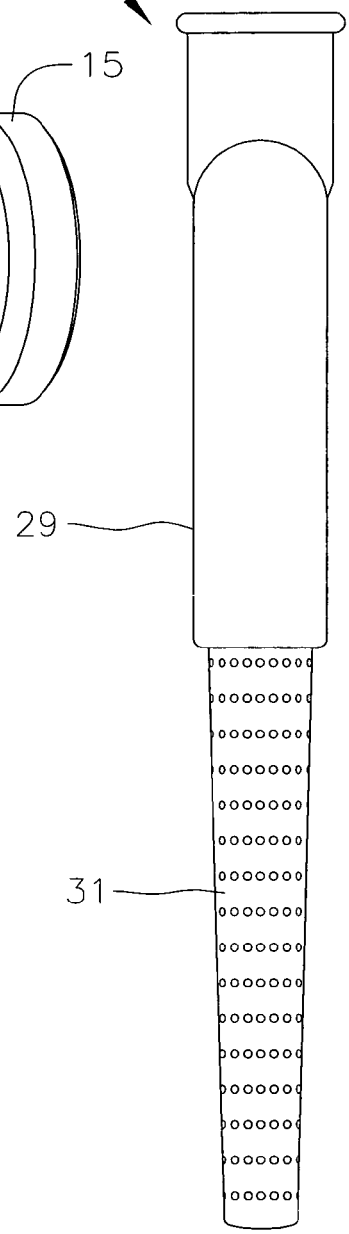
FIG. 7 is a front view of another embodiment of the mud filter according to the invention.

FIG. 7 shows an embodiment of the mud filter 26 having an upper portion 29 that is nonporous and a lower portion 31 that is porous. The porous structure of the lower portion 31 may include any of the porous structures described above. This embodiment is useful, for example, when the mud filter 26 is received within the washpipe 14 and an upper portion of the washpipe includes a curved gooseneck 15. The curvature of the gooseneck 15 causes an increased turbulence in the flow of the drilling mud. As a result, it is advantageous for the upper portion 29 of the mud filter 26 to be comprised of a nonporous material to increase the structural strength of the upper portion 29 of the mud filter 26 so that the turbulence of the drilling mud does not fracture the mud filter 26.

Figure 8:
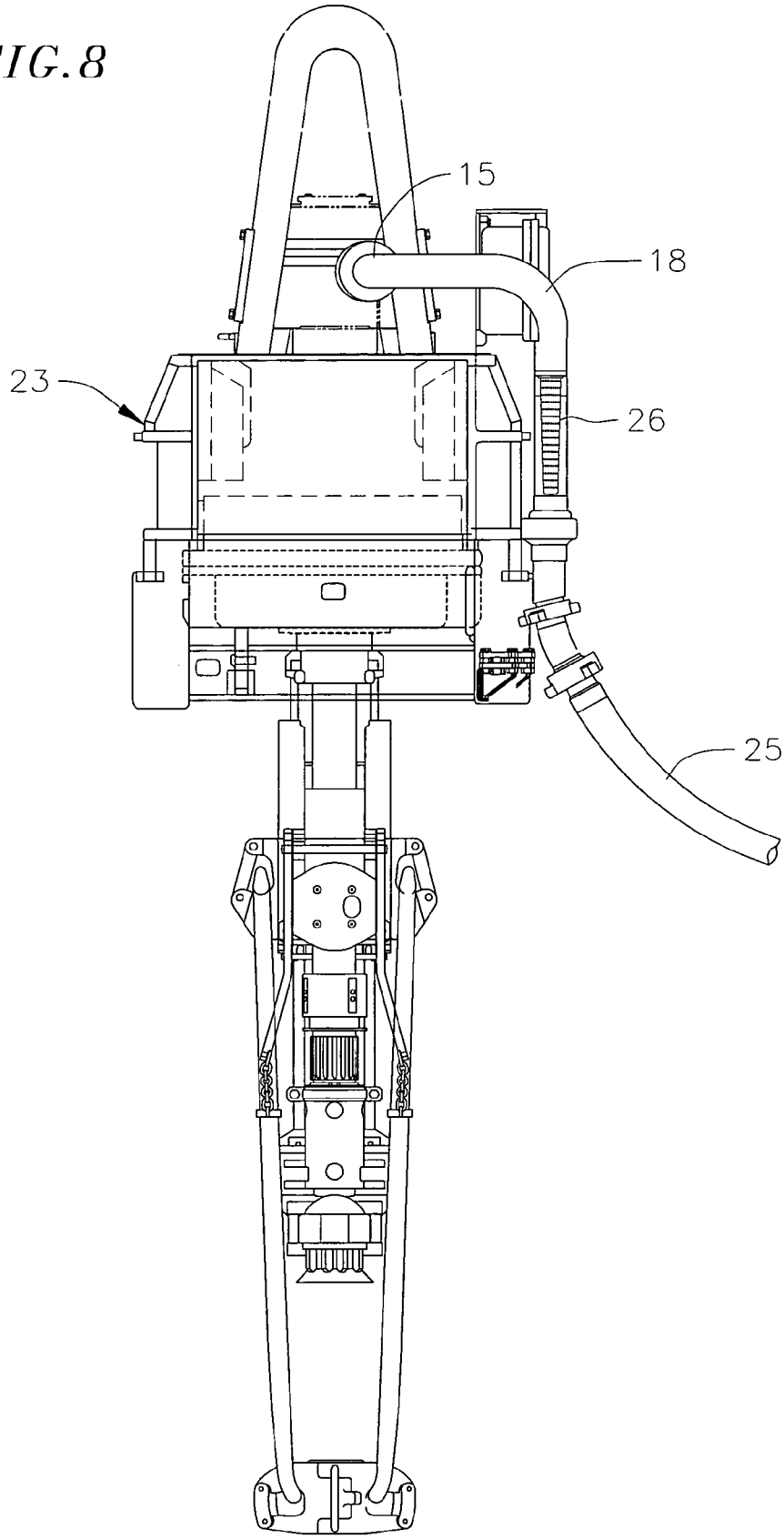
FIG. 8 is a schematic of a top drive drilling apparatus, having a mud filter disposed within an S-pipe.

FIG. 8 shows another embodiment of the invention, where the mud filter 26 is received within the S-pipe 18. The mud filter 26 may be received within the S-pipe 18 as is described above with respect to the positioning of the mud filter 26 within the saver sub 24.

This invention is also directed to a method of filtering drilling mud using the above described apparatus. In this embodiment, during a drilling operation, the drilling mud is pumped through the drilling mud fluid passageway 8. As the drilling mud enters the longitudinal cavity 44 of the mud filter 26, the mud filter 26 allows the mud to pass through the mud filter sidewalls 48 and bottom wall 50, but does not allow the waste products to pass through the mud filter sidewalls 48 and bottom wall 50. As the waste products accumulate or "stack up" inside the longitudinal cavity 44 of the mud filter 26, the pressure of the drill mud increases. When pressure in the drilling mud reaches a level that indicates that the longitudinal cavity 44 of the mud filter 26 is substantially occupied by the waste products, a new mud filter 26 is inserted in the drilling mud fluid passageway, for example, in the washpipe 14, the S-pipe 18, or the saver sub 24. This process of installing and replacing the mud filter 26 can be repeated as needed during the drilling process.

Although a top drive system has been described above, in alternative embodiments any suitable overhead drilling system may be used such as a power swivel. It should be understood that the embodiments described and illustrated herein are illustrative only, and are not to be considered as limitations upon the scope of the present invention. Variations and modifications may be made in accordance with the spirit and scope of the present invention. Therefore, the invention is intended to be defined not by the specific features of the preferred embodiments as disclosed, but by the scope of the following claims.

What is claimed is:

1. A filter system for filtering drill bit cuttings, shavings, and other abrasive articles from a drilling mud that is passed through an oil or gas well drilling system comprising:

an overhead rotary drilling system;

a drill string connected to the overhead rotary drilling system; and a mud filter for filtering the drilling mud, wherein the mud filter is disposed within a drilling mud fluid passageway that extends within the overhead drilling system.

2. The filter system of claim 1, wherein the mud filter is comprised of a porous structure.

3. The filter system of claim 2, wherein the porous structure comprises a solid material having a plurality of openings disposed therein.

4. The filter system of claim 3, wherein solid material is a metal.

5. The filter system of claim 1, wherein the overhead rotary drilling system comprises a washpipe assembly and wherein the mud filter is disposed within the wash pipe assembly.

6. The filter system of claim 1, wherein the overhead rotary drilling system comprises a washpipe assembly, having a gooseneck extending therefrom for receiving an S-pipe, and wherein the mud filter is disposed within the S-pipe.

7. The system of claim 1, wherein the mud filter comprises an annular mounting ring and a stem extending therefrom, wherein an upper portion of the stem is nonporous and a lower portion of the stem is porous.

8. The filter system of claim 7, wherein the nonporous upper portion of the stem of the mounting filter comprises at least one quarter of the length of the stem.

9. The filter system of claim 7, wherein the nonporous upper portion of the stem of the mounting filter comprises at least one half of the length of the stem.

10. A filter system for filtering drill bit cuttings, shavings and other abrasive articles from a drilling mud that is passed through an oil or gas well drilling system comprising:

a top drive drilling system comprising a washpipe assembly, a gooseneck extending from the washpipe assembly and an S-pipe connected to the gooseneck; and a mud filter for filtering the drilling mud, wherein the mud filter is disposed within a drilling mud fluid passageway that extends within the top drive-to alleviate an antecedent basis error system.

11. The filter system of claim 10, wherein the mud filter is comprised of a porous structure.

12. The filter system of claim 11, wherein the porous structure comprises a solid material having a plurality of openings disposed therein.

13. The filter system of claim 12, wherein solid material is a metal.

14. The filter system of claim 10, wherein the mud filter is disposed within the washpipe assembly.

15. The filter system of claim 10, wherein the mud filter is disposed within the S-pipe,

16. The filter system of claim 10, wherein the mud filter comprises an annular mounting ring and a stem extending therefrom, wherein an upper portion of the stem is nonporous and a lower portion of the stem is porous.

17. A method for filtering drill bit cuttings, shavings, and other abrasive articles from a drilling mud that is passed through an oil or gas well drilling system comprising:

providing a drill string;

providing an overhead drilling system that rotatably drives the drill string, the overhead drilling system comprising a drilling mud fluid passageway;

providing a mud filter for filtering the drilling mud; and positioning the mud filter within the drilling mud fluid passageway of the overhead drilling system.

18. The method of claim 17, wherein the mud filter is a porous structure.

19. The method of claim 18, wherein forming the porous structure comprises a solid material having a plurality of openings in the solid material.

20. The method of claim 19, wherein the solid material comprises a metal material.

21. The method of claim 17, wherein the overhead drilling system comprises a washpipe assembly and wherein the mud filter is disposed within the washpipe assembly.

22. The method of claim 17, wherein the overhead drilling system comprises a washpipe assembly, having a gooseneck extending therefrom for receiving an S-pipe, and wherein the mud filter is disposed within the S- pipe.

23. The method of claim 17, wherein the mud filter comprises an annular mounting ring and a stem extending therefrom, wherein an upper portion of the stem is nonporous and a lower portion of the stem is porous.

24. The method of claim 17, wherein the nonporous upper portion of the stem of the mounting filter comprises at least one half quarter of the length of the stem.

25. The method of claim 24, wherein the nonporous upper portion of the stem of the mounting filter comprises at least one half of the length of the stem.

26. A method for filtering drill bit cuttings, shavings and other abrasive articles from a drilling mud that is passed through an oil or gas well drilling system comprising:

providing a drill;

Providing a top drive drilling system that ratably drives the drill string, wherein the top drive comprises a washpipe assembly, a gooseneck extending from the washpipe assembly and an S-pipe connected to the gooseneck;

providing a mud filter for filtering the drilling mud; and positioning the mud filter in a drilling mud fluid passageway within the top drive.

27. The method of claim 26, wherein the mud filter is a porous structure.

28. The method of claim 27, wherein the porous structure comprises a solid material having a plurality of openings therein.

29. The method of claim 28, wherein the solid material comprises a metal material.

30. The method of claim 26, wherein the overhead drilling system comprises a washpipe assembly and has been removed to alleviate an antecendent basis and redundancy error within the washpipe assembly.

31. The method of claim 26, wherein the overhead mud filter is disposed within the S-pipe.

32. The method of claim 26, wherein the mud filter comprises an annular mounting ring and a stem extending therefrom, wherein an upper portion of the stem is nonporous and a lower portion of the stem is porous.

* * * * *

UNITED STATES PATENT AND TRADEMARK OFFICE

CERTIFICATE OF CORRECTION

PATENT NO. : 6,976,546 B2
APPLICATION NO. : 10/453370
DATED : December 20, 2005
INVENTOR(S) : Herst It is certified that error appears in the above-identified patent and that said Letters Patent is hereby corrected as shown below:

On the Title Page

| | |
|---|---|
| (56) References Cited<br>U.S. Patent Documents | Insert --4,363,366 A 12/1982 Hilty<br>4,526,230 A 07/1985 Kojicic<br>4,583,594 A 04/1986 Kojicic<br>4,649,996 A 03/1987 Kojicic et al.<br>4,750,571 A 06/1988 Geeting-- |
| Column 6, line 10, Claim 1 | After “the overhead”,<br>Insert --rotary-- |
| Column 6, line 20, Claim 5 | Delete “wash pipe”,<br>Insert --washpipe-- |
| Column 6, line 27, Claim 7 | Before “system of”,<br>Insert --filter-- |
| Column 6, line 45, Claim 10 | Delete “drive-to”,<br>Insert --drive to-- |
| Column 6, line 51, Claim 15 | Delete “S-pipe,”,<br>Insert --S-pipe.-- |
| Column 7, line 21, Claim 24 | Delete “claim 17”,<br>Insert --claim 23-- |
| Column 7, line 23, Claim 24 | Delete “half” |
| Column 7, line 24, Claim 25 | Delete “claim 24”,<br>Insert --claim 23-- |
| Column 7, line 30, Claim 26 | After “drill”,<br>Insert --string-- |
| Column 7, line 31, Claim 26 | Delete “Providing a top drive drilling system that ratably”,<br>Insert --providing a top drive drilling system that rotatably-- |

UNITED STATES PATENT AND TRADEMARK OFFICE

CERTIFICATE OF CORRECTION

PATENT NO. : 6,976,546 B2
APPLICATION NO. : 10/453370
DATED : December 20, 2005
INVENTOR(S) : Herst It is certified that error appears in the above-identified patent and that said Letters Patent is hereby corrected as shown below:

| | |
|---|---|
| Column 8, lines 14-17, Claim 30 | Delete "the overhead drilling system comprises a washpipe assembly and has been removed to alleviate an antecendent basis and redundancy error",<br>Insert --the mud filter is disposed-- |
| Column 8, line 17, Claim 31 | Delete "overhead" |

Signed and Sealed this

Twelfth Day of December, 2006

JON W. DUDAS
*Director of the United States Patent and Trademark Office*